United States Patent [19]
Preston

[11] 4,406,070
[45] Sep. 27, 1983

[54] DIELECTRIC CONDITIONING

[76] Inventor: Mark D. Preston, Meeting House Hill Rd., Mason, N.H. 03048

[21] Appl. No.: 310,736

[22] Filed: Oct. 13, 1981

[51] Int. Cl.[3] ..... F26B 3/34; F26B 23/08
[52] U.S. Cl. ..... 34/1; 34/48; 219/10.41; 219/10.73; 219/10.81
[58] Field of Search ..... 34/1, 48; 219/10.81, 219/10.77, 10.75, 10.73, 10.41

[56] References Cited

U.S. PATENT DOCUMENTS 3,387,378 6/1968 Newsom ..... 34/1
3,878,619 4/1975 Hodgett et al. ..... 34/1

*Primary Examiner*—Larry I. Schwartz
*Attorney, Agent, or Firm*—Maurice R. Boiteau

[57] ABSTRACT

There is disclosed in the present application a method and apparatus for treating variable batches of moist dielectric materials by the application of radio frequency energy which reduces the moisture content. According to the present method and by the use of the present apparatus, full power or another pre-determined power level from a radio frequency power source is maintained on the load by an electro-mechanical adjusting device which incrementally reduces the coupling between the source and the load until the boiling point of water is reached. After the boiling point is reached the coupling is incrementally increased to reach a pre-determined moisture content in the material being treated. There is included in the present apparatus, means for counting the number of discrete coupling adjustments in both directions. The difference between these two counts is utilized to select the final average moisture content of the batch and for terminating the treatment cycle when the load has reached the selected average moisture content.

9 Claims, 9 Drawing Figures

DIELECTRIC CONDITIONING

The present invention relates generally to improvements in the batch treatment of materials to redistribute and usually reduce their moisture by subjecting them to radio frequency energy. More particularly, the present invention relates to methods and apparatus for the automatic control of the coupling of radio frequency power sources to materials and the termination of treatment cycles when a certain pre-determined average moisture level has been reached. In some respects, the present application is a continuation-in-part of my co-pending application for United States Letters Patent Ser. No. 113,659, filed Jan. 21, 1981.

In the batch treatment of materials such as plywood veneer, skins and leather, paper products, sheets of natural and synthetic materials, a valuable consideration is obtaining uniform results in the moisture content of the materials after the completion of the treatment cycle. With conventional treatment, however, such uniformity is achieved either by careful monitoring of the moisture content during the treatment cycle, with appropriate instrumentation or subjecting all batches to a uniform treatment cycle if the size and moisture characteristics of each batch as originally loaded in the dielectric treatment apparatus is closely controlled. When the moisture content is monitored, the information is usable for manually adjusting the coupling or power level of the radio frequency energy source and termination of the treatment cycle. The fact that considerable skill, judgment and experience are necessary for controlling the dielectric treating process in order to obtain acceptably uniform product, results in unacceptably high operating labor costs. On the other hand, since in most cases, the materials being treated are frequently irregular in terms of moisture content, size and density, assembling uniform batches for dielectric treatment is impractically expensive.

It is accordingly a general object of the present invention to improve the accuracy of control of dielectric treatment processes and apparatus.

Another object is to provide automatic control of dielectric treating processes and apparatus, which automatic control is effective even when successive batches being operated upon are of different sizes, densities and moisture contents within relatively broad limits.

Still another more specific object is that of obtaining uniform moisture content of the treated materials at the end of the operating cycle.

In the achievement of the foregoing objects, a feature of the invention relates to means incorporated in the apparatus for adjusting coupling in discrete steps to maintain radio frequency energy input to the load, at or near full power within narrow limits as water contained in the load is changed in either temperature or quantity. With the passage of time after a load is first subjected to radio frequency energy and while the application of radio frequency power continues, the water content under conventional uncontrolled conditions is first heated to its boiling point by the energy and thereafter evaporates. As the temperature of the water in the load rises, there is greater absorption of energy by the load. However, after the boiling point is reached, water begins to evaporate and as the quantity of water in the load is decreased, absorption of energy is decreased. These conditions of changing energy absorption by the load with conventional uncontrolled processes and apparatus are uneconomical since the apparatus is only permitted to operate at or near full power during a relatively short portion of a treatment cycle. However, by reducing coupling in discrete steps during heating of the water toward its boiling point and thereafter similarly increasing coupling as water evaporates, in accordance with the present feature, it is possible to operate apparatus within a narrow range at or close to full power and thus render the apparatus far more efficient in its operation.

According to a related feature of the invention, the number of steps in reducing the coupling is counted and thereafter the steps increasing the coupling are subtracted from the reducing steps to establish the termination of the treatment cycle so as to obtain a pre-determined moisture content of the processed load.

The foregoing objects and features will be more fully understood and appreciated from the following detailed description of an illustrative embodiment of the present invention, taken in connection with the accompanying drawings in which.

Figure 1:
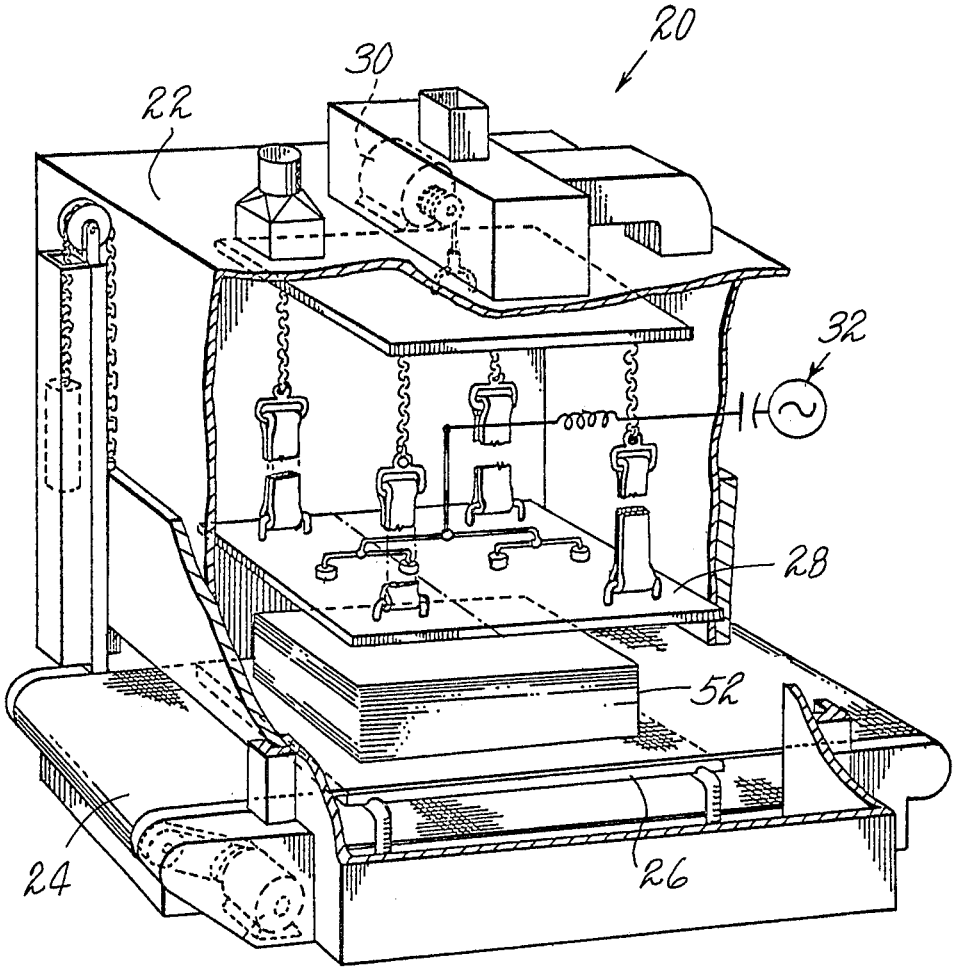
FIG. 1 is a view in perspective and partly in cross-section of an apparatus essentially as disclosed in my co-pending application, which is useful for carrying out the present invention.

Turning now to the drawings, particularly FIG. 1, there is shown an apparatus disclosed and described in detail in my above identified co-pending application and including a housing particularly adapted to re-conditioning batches of plywood veneer with r.f. energy to redistribute and usually reduce the average moisture content. Usually, at the start of the operating cycle in the apparatus, the average moisture of individual plywood veneer sheets varies greatly from sheet to sheet and in different areas of the same sheet and the compressed heights of successive batches are frequently variable to a substantial degree. In addition, because of warping and distortion in imperfectly conditoned sheets, the density of successive batches is unpredictable.

The apparatus of FIG. 1, indicated generally at 20, includes an enclosure into which batches of veneer are introduced on a conveyor belt 24 to a position between a fixed electrode 26 and a movable electrode 28. In order to control the redistribution of moixture in individual sheets of veneer and in the batch as a whole, the movable plate is raised and lowered by a motor 30 as more fully explained in the co-pending application. Associated with the enclosure 22 and the electrodes 26 and 28 is an electric circuit including an r.f. power unit indicated generally at 32 and coupled to the electrodes.

Figure 2:
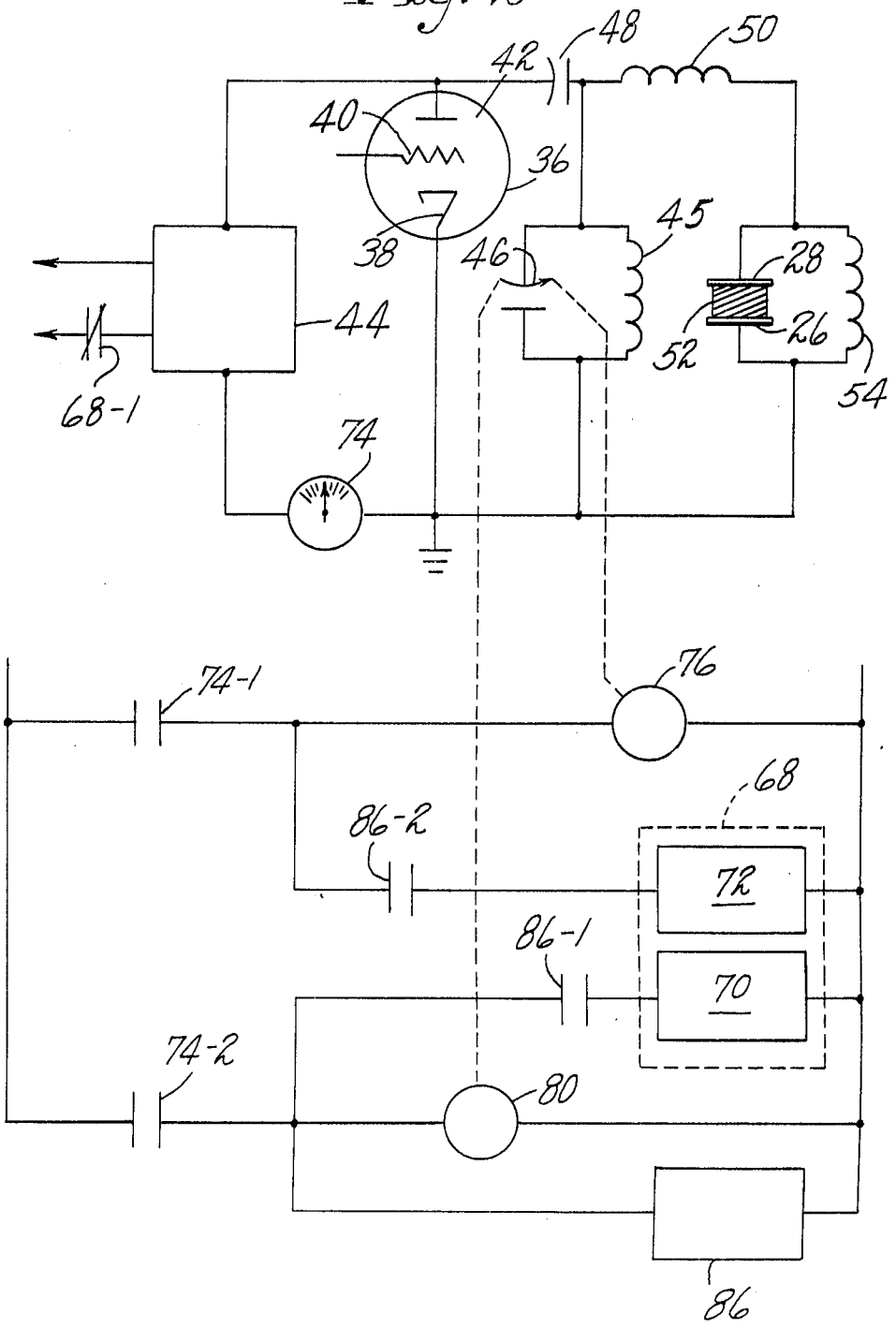
FIG. 2 is a schematic diagram of an electrical circuit associated with the apparatus of FIG. 1.

There is shown in FIG. 2, a schematic representation of the circuit including the r.f. power unit 32 and associated controls according to the present invention. The r.f. power unit is in the form of an oscillator circuit including a triode 36 having a cathode 38, a grid 40 and a plate or anode 42. Voltage is supplied to the plate 42 by a d.c. power supply 44 and the plate is connected to a tank circuit comprising an inductance 45 and a variable capacitor 46 through a coupling condenser 48. R.f. energy is coupled to the load from the junction of the tank circuit through an inductance 50 to movable electrode 28, the fixed electrode 26 being grounded. Paralleling the electrodes and a load 52 is another inductance 54.

The apparatus above described in connection with FIG. 1 and the circuits already described in connection with FIG. 2 are essentially like or the equivalent of those disclosed in my above identified co-pending application. Control devices now to be described are useful, however, with a wide variety of different apparatus for treating a variety of moisture containing materials, with r.f. energy.

Figure 3:
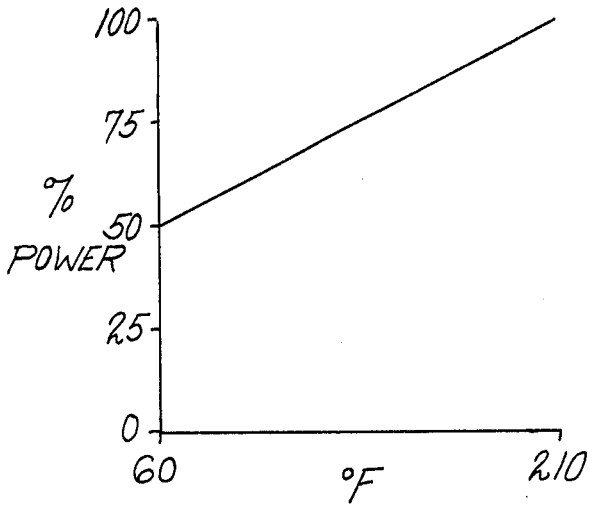
FIG. 3 is a graphic representation of the effect of temperature of a load upon power absorption without making any adjustment either in coupling or output of the r.f. power supply.
Figure 4:
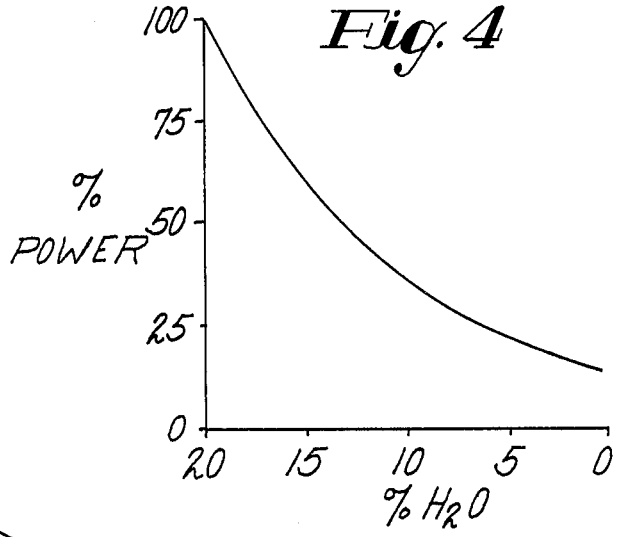
FIG. 4 is a graphic representation of the effect of the loss of moisture upon power absorption, again without making any adjustments in controls either of coupling or power.
Figure 5:
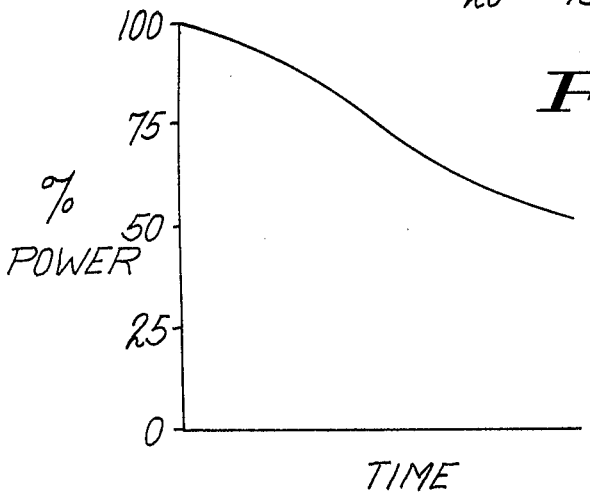
FIG. 5 is a graphic representation of the combined effect on power absorption by a typical moisture containing load, of increases in the temperature of both solids and water and the loss of water through evaporation.
Figure 6:
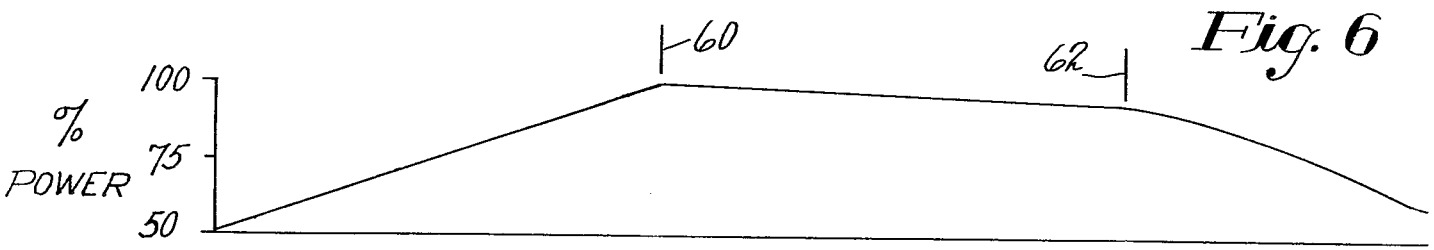
FIG. 6 is a graphic representation of power absorption by a moisture containing load, plotted against time without any adjustments in controls either of coupling or r.f. power output.

Before proceeding with a description of the circuitry employed according to the present invention for controlling the application of r.f. power to moisture containing loads and the termination of operating cycles of dielectric conditioning apparatus, phenomena upon which the present invention is based will first be described in connection with FIGS. 3 through 6. There is shown in FIG. 3, a graph representing the power absorption by a load of moist material in a typical apparatus, the plate voltage of the r.f. power oscillator having been adjusted for coupling approximately fifty percent of maximum available power to the load at the start of an operating cycle. As the water contained in the material is heated by the r.f. energy, power absorption by the load increases until one hundred percent of available power is reached at the boiling point of the water, if the initial adjustment of plate voltage has been accurately proportional to the water content of the material and no further adjustments are made to the apparatus. FIG. 4 is a graphic representation of the effect of the loss of moisture through evaporation after the boiling point of the water is reached and r.f. energy starting at one hundred percent of available power continues to be applied with no further adjustments in the controls of the r.f. power oscillator. Under these conditions, the power transfer to the load declines with the loss of moisture until, when the load is completely dry, the power absorption is down to less than twenty-five percent. There is shown in FIG. 5 the combined effect of loss of moisture and heating of the material being treated by the application of r.f. energy. Since the loss of moisture, which reduces energy absorption is being partially counteracted by heating of the material, which causes increased r.f. energy absorption, the load absorbs about fifty percent of the available power when the material is dry but heated. FIG. 6 illustrates the changes in the power absorption by a moist load in a dielectric conditioning or treating apparatus, as a result of changes in the temperature and quantity of water during a typical operating cycle without changing any controls in the r.f. power supply. Starting with a plate voltage adjustment of the oscillator to provide approximately fifty percent absorption of maximum available power by the load, with the heating of the water content, the absorption rises to one hundred percent when the water reaches the boiling point and begins to evaporate. One hundred percent absorption is reached if the initial adjustment has been accurate for the average moisture content of the load. The water continues to evaporate during a somewhat balanced period indicated in FIG. 6 between index lines 60 and 62 representing respectively the reaching of the boiling point of water, the point of maximum energy absorption and a slight increase in load temperature as approximately one percent of the moisture is lost through exaporation. After passing the point represented by the index line 62, there is little further increase in load temperature but a rapid loss of moisture as energy absorption declines to a value below seventy-five percent of available power.

Figure 7:
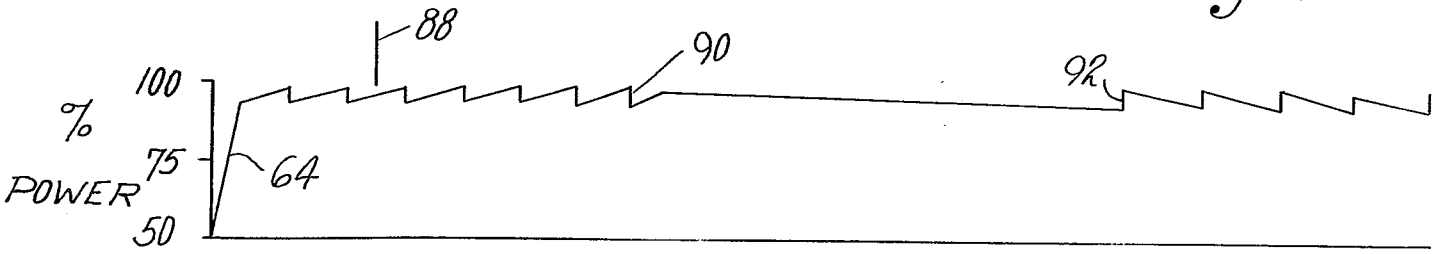
FIG. 7 is a graphic representation similar to FIG. 6 but showing a plurality of discrete adjustments, first to near maximum power input, then a plurality of adjustments in coupling including several initial downward steps and near the end of the treatment cycle, several upward steps.

The treatment of moist materials without adjustment of the apparatus, as depicted in FIG. 6, is inefficient and much more time-consuming than is the case with automatic controls in accordance with the present invention. In addition, as will be seen, the present devices and methods permit the accurate control of the final moisture content of a load within broad limits of initial height or thickness, density and moisture content. The control, as shown in FIG. 7, is accomplished by initially increasing coupling of r.f. energy to the load in a first step 64, which raises the absorption of r.f. energy by the load to within ten percent of maximum available power. Thereafter, as the water in the material is heated and accordingly absorbs more r.f. energy, a full power condition is reached, which causes a downward adjustment step repeated several times during a normal dielectric treatment cycle. The degree of dryness in the processed load is determined by the difference in the number of discrete adjustments downward in the initial part of the operating cycle of the apparatus and upward near the end of the operating cycle. Thus if there are many more downward than upward adjustments, the load will have a greater moisture content at the end of the treatment cycle.

Figure 8:
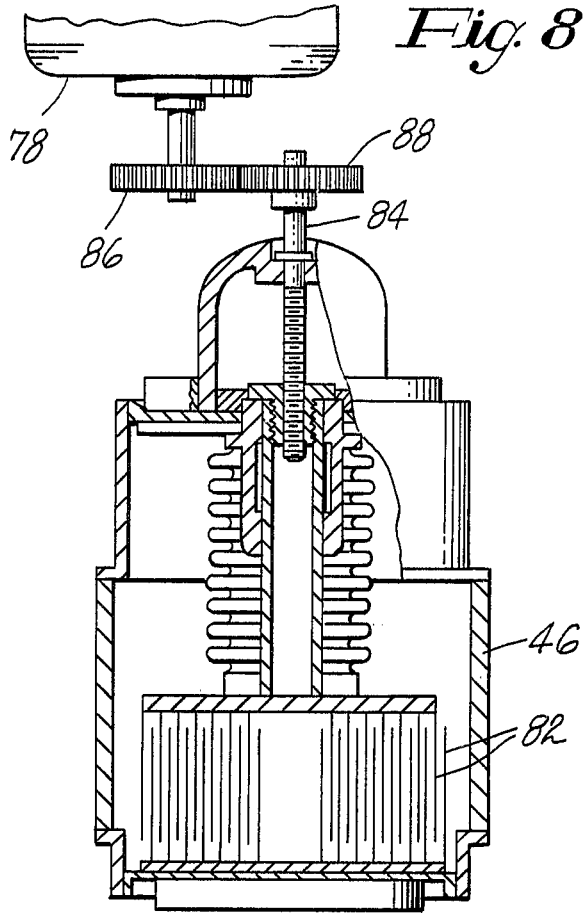
FIG. 8 is a view in front elevation and partly in cross-section of an adjustable capacitor and its actuating means, forming a part of a coupling adjusting means according to the present invention.

For controlling the operation of the apparatus by discrete adjustments, there is provided, as seen in FIG. 2, a circuit including an add and subtract counting switch assembly 68, having add and subtract circuits 70 and 72 respectively. The assembly 68, which is of a commercially available type, may be so adjusted that a pair of normally closed contacts 68-1 operated by and forming a part of the assembly will open after a certain number of pulses counted in the add mode have been reduced to zero by an equal number of pulses counted in the subtract mode. The initial adjusting step 64 and all succeeding adjusting steps are controlled in their magnitude and timing by a meter relay 74 connected in the circuit to measure plate current of the oscillator triode 36. The relay 74 includes adjustable normally-open contacts 74-1 and 74-2 which close respectively to increase and decrease coupling of the load to the r.f. power supply. Thus, if the power absorbed by the load is less than the pre-set minimum, a condition which obtains when the apparatus is first energized with a new load, the contacts 74-1 close and energize a field winding 76 of a motor 78, shown in FIG. 8, which is thereby actuated to adjust the variable capacitor 46 to increase the coupling between the load and the r.f. power supply, as will hereinafter be explained. After the initial adjustment of the capacitor 46, each time that power absorption reaches a pre-set upper limit of the meter relay, the contacts 74-2 close, causing the energization of a second field winding 80 of the motor 78 thereby actuating the motor to adjust the capacitor 46 to reduce the coupling between the load and the r.f. power supply. For the sake of simplicity, the windings 76 and 80 associated with the opearation of the motor 78, have been described in general functional terms and illustrated as directly connected to the capacitor 46. It will be readily understood, however, that the windings 76 and 80 are part of the motor 78, which is of the reversible type and that the energization of one winding causes the motor to rotate in one direction, while energization of the other winding causes rotation in the opposite direction, rotation in either direction thus making the necessary adjustments in the capacitor 46. It will also be understood that the capacitor 46 is typically a commercially available hermetically sealed adjustable type having a plurality of concentric plates 82 and its adjustment either to increase or decrease capacity is by rotation of a shaft by the motor 78 through driving and driven gears 86 and 88 respectively. The manner in which adjustments of the capacitor 46 change the coupling of the r.f. power supply to the load 52 will be explained below.

Returning now to FIG. 2, there is shown a counter 86 having two pairs of normally-open contacts 86-1 and 86-2 located respectively in series with the add circuit 70 and the subtract circuit 72. The counter 86 is of a commercially available type in which the normally open contacts close after the mechanism has received a pre-set number of electrical impulses. Thus, if the mechanism 86 is set for two impulses before closing the contacts 86-1 and 86-2, the adding and subtracting circuits 70 and 72 may only be energized after the motor 46 has been actuated two times to reduce the coupling, as indicated by an index marker 88 in FIG. 7. Thereafter, each actuation of the motor 46 to decrease the coupling of the load to the r.f. power will be counted by the adder circuit 70 through the closed contacts 74-2 and 86-1. After a last decoupling adjustment indicated at 90 in FIG. 7, the water in the load reaches the boiling point without requiring a further decoupling adjustment because the power absorbed by the load never quite reaches the upper limit set by the meter relay 74. Following the reaching of the boiling point of water in the load, there is an extended period during which power absorption by the load declines slowly as the loss of moisture through evaportion, which tends to reduce power absorption is balanced in part by a rise in the load temperature which tends to increase power absorption. It will be noted at this point that the period represented in FIG. 7 between reaching the boiling point of water and a first upward step 92 in the coupling, is generally comparable to the period indicated between index markers 60 and 62 in FIG. 6, representing uncorrected coupling between r.f. power supply and load. However, the time required to reach the boiling point of water represented by the interval between the start of the cycle and the final downward adjusting step 90 in FIG. 7 is much shorter than the corresponding period between the start of the cycle and the index 60 representing the boiling point of water in the self-regulating cycle graphically illustrated by FIG. 6. The same is true of the later parts of the two cycles in which the interval between the first upward adjustment 90 and the end of the controlled cycle, depicted in FIG. 7, is actually considerably shorter in duration than the corresponding period between the index marker 62 and the end of the uncontrolled cycle depicted in FIG. 6, for loads of comparable size and moisture content. The reason for the reduced duration of initial and final periods of the controlled cycle over the corresponding periods of the uncontrolled cycle is that more power is being coupled into the load by the step adjustments in the cycle depicted by FIG. 7 during these periods, than the load would receive naturally in accordance with the uncontrolled cycle of FIG. 6. It will accordingly be realized that time represented along the x axis of FIGS. 6 and 7 is only generally comparable during the central portion of the two cycles and that the two figures have been shown as of similar overall length to facilitate juxtaposition for purposes of comparing the two cycles in their parts and not to indicate overall equality of duration of the two cycles. Stated another way, the two graphs of FIGS. 6 and 7 are not intended to portray either equal or linear time bases.

Figure 9:
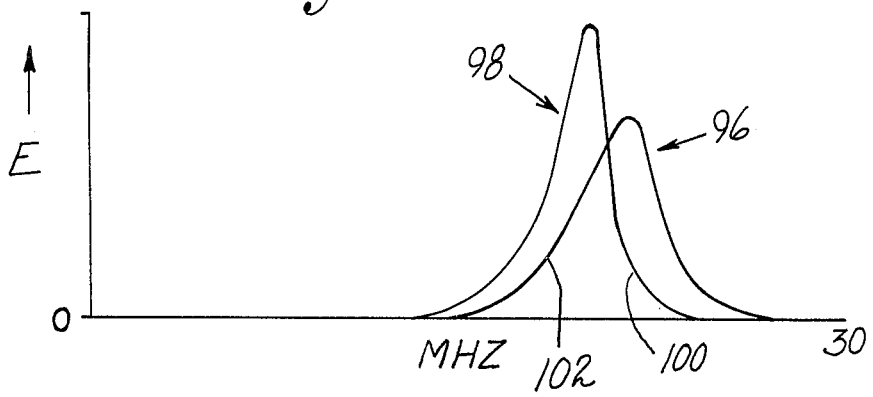
FIG. 9 is a graphic representation of the effect of differences in resonant frequency of load and r.f. power source.

The mode of the step adjustments in coupling, which have been discussed above, are the result of adjustments in the operating frequency of the r.f. power supply to coincide more closely with the resonant frequency of the load. In FIG. 9, the frequency response or absorption capability of the load is depicted by a curve 96 which represents the voltage which may be coupled to the load at a part of the frequency spectrum. On the other hand, a curve 98 represents the voltage available from the r.f. power supply over another part of the frequency spectrum. As the load is affected by the r.f. energy, being heated and losing moisture, its resonant frequency changes as the dielectric constant, which determines its effective capacity, is correspondingly changed. Assuming the relative conditions of load resonant frequency and r.f. power frequency depicted in FIG. 9, heating of the load takes place in that area bounded between the upper shoulder 100 of the r.f. power oscillator curve and the lower shoulder 102 of the load curve. If power transfer from source to load is to be increased, the frequency of the power source is increased by reducing the capacity of the capacitor 46 in steps, as already described, so that the output of the source more closely coincides with the resonant frequency of the load. On the other hand, decreases in the operating frequency of the r.f. power source are similarly caused by step increases in the value of the capacitor 46 also as already described.

From the foregoing, it is seen that the present control devices and methods are effective for producing improved efficiency and accuracy in the use of dielectric heating apparatus applied to moiture containing materials. It will also be appreciated that the reference to the apparatus of my co-pending application has been for the purpose of illustrating the present control devices and methods applied to a complete treatment apparatus but that the present control devices and methods are much more broadly applicable to a wide variety of treatment processes which require efficiency in the use of the apparatus and accurate and automatic control to produce uniform moisture content in treated products, starting with initial loads which vary broadly in such characteristics as size, density and moisture content. It is accordingly not intended that the foregoing description and accompanying drawings be taken as limitations, but rather that the scope of the invention be interpreted in terms of the appended claims.

Having thus disclosed my invention, what I claim as new and desire to secure by Letters Patent of the United States is:

1. A controller for a dielectric batch treating apparatus having a radio frequency energy source and means for coupling the source to a moist dielectric drying load comprising means for incrementally reducing the coupling between the source and the load until the boiling point of water is reached and for thereafter incrementally increasing the coupling to maintain a pre-determined power level to the load, means for individually and separately counting the adjustments in each direction and means for interrupting the operating cycle of the apparatus in response to reaching a pre-determined combination of increasing and decreasing adjustments.

2. A controller according to claim 1 further comprising means for postponing the counting of decreasing coupling adjustments by the counting means until a pre-determined number of decreasing adjustments have occurred to regulate the final moisture content of the load at the end of the operating cycle of the apparatus.

3. A controller according to claim 1 further characterized in that the radio frequency energy source includes an oscillator tube having an anode and further comprising an adjustable power sensing device in series with the oscillator for energizing the coupling adjusting means in response to sensed changes in anode current.

4. A controller according to claim 3 further characterized in that the means for delaying the counting of decreasing adjustments includes a counter energized by pulses from the power sensing device.

5. A controller according to claim 2 further characterized in that the counting means is actuated only after a delay of a pre-determined number of adjustments and that the counting means controls the interruption of the operating cycle of the apparatus when the increasing adjustments equal the decreasing adjustments occurring after the postponement.

6. A controller according to claim 5 further characterized in that the delay means is adjustable to change the extent of the postponement.

7. A method of controlling the operation of a dielectric treating apparatus having a radio frequency energy source including an oscillator tube having an anode, comprising the steps of sensing the anode current while a moisture-containing load is being subjected to radio frequency energy by the apparatus, incrementally reducing the coupling of the radio frequency source to the load in discrete steps until the boiling point of water is reached and thereafter increasing the coupling also in discrete steps in response to changes in anode current to maintain power absorption by the load between predetermined upper and lower limits, counting the number of discrete adjustments in each direction and terminating the operating cycle of the apparatus after a predetermined count has been reached in the number of adjustments in each direction.

8. The method according to claim 7 further comprising the step of delaying the count of discrete coupling adjustments for terminating the operating cycle until after the occurrence of a pre-determined number of discrete decoupling adjustments have been made.

9. Apparatus for treating a load of moisture-containing material with radio frequency energy comprising a source of radio frequency energy, means for applying the radio frequency energy from the source to the load, means for incrementally reducing the coupling between the radio frequency source and the load in discrete steps until the boiling point of water is reached and thereafter increasing the coupling also in discrete steps, means for separately counting the discrete adjustments in each direction and means for terminating the operating cycle of the apparatus in response to reaching a pre-determined combination of increasing and decreasing adjustments.

* * * * *